United States Patent [19]

Powers et al.

[11] 4,080,164

[45] Mar. 21, 1978

[54] TEXTILE SCOURING

[75] Inventors: John R. Powers, Mount Pleasant; Frances C. Miller, Charleston, both of S.C.

[73] Assignee: Westvaco Corporation, New York, N.Y.

[21] Appl. No.: 691,569

[22] Filed: Jun. 1, 1976

[51] Int. Cl.[2] ..... B08B 3/00

[52] U.S. Cl. ..... 8/137; 252/89 R; 252/156

[58] Field of Search ..... 8/137; 252/89, 156

[56] References Cited

U.S. PATENT DOCUMENTS

| | | | |
|---|---|---|---|
| 3,734,859 | 5/1973 | Ward | 252/108 |
| 3,956,161 | 5/1976 | Woodward | 252/89 |

OTHER PUBLICATIONS

Fairchild's Dictionary of Textiles (1967) Fairchild Publ., p. 513.

*Primary Examiner*—William E. Schulz

*Attorney, Agent, or Firm*—Ernest B. Lipscomb, III; Terry B. McDaniel

[57] ABSTRACT

Disclosed herein are alkaline baths for scouring textiles containing as a cleaning composition at least 0.05% of a mixture of a nonionic surfactant and a polycarboxylic acid or salt thereof of the formula

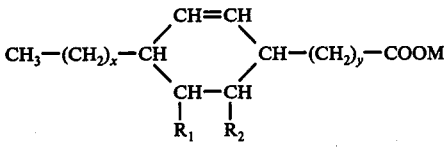

wherein $x$ and $y$ are integers from 3 to 9, $x$ and $y$ together equal 12, $R_1$ and $R_2$ are selected from the group consisting of hydrogen and COOM with at least one of $R_1$ and $R_2$ being COOM, and wherein M is a member of the group consisting of hydrogen, sodium, potassium, lithium and ammonium, the proportion of nonionic surfactant to polycarboxylic acid or salt thereof being between about 1:0.4 and about 1:3.

6 Claims, No Drawings

TEXTILE SCOURING

BACKGROUND OF THE INVENTION (1) Field of the Invention

This invention relates to alkaline scouring baths useful for removing impurities from textiles and to a process for so treating such textiles. More particularly, this invention relates to alkaline scouring baths containing as a cleaning agent a mixture of nonionic surfactant and certain polycarboxylic acids or salts thereof.

(2) The Prior Art

Textiles, especially natural cellulosic fibers such as cotton, contain impurities that adhere to the fibers, such as processing chemicals, residues of the ginning process like seed husks, leaves, shives and the like, natural fats and waxes, collenchymatous, lignin, and pectin. Removing these impurities prior to dyeing is desirable to prevent dark colored particules in the fabric and uneven dyeing. The impurities are removed from a majority of the fibers produced and the process is referred to as scouring. Scouring is frequently used in combination with bleaching. Scouring may be carried out on loose fibers, slivers, yarn or fabrics; but for ease of handling, fabric form is to be preferred. For example, surgical cotton is scoured and bleached as raw stock; whereas, yarn for dyeing is bleached, for example, in packages. Piece goods are generally scoured and bleached in rope form because it is cheaper to operate in this way; certain types, however, require treatment in open width.

Scouring, as used herein, means the use of soaps, detergents and alkalies to remove naturally occurring waxes and soils, oils, and protective agents applied to facilitate processing, as well as accidental contamination by mill greases and dirt, from fibers, yarns and fabrics, i.e., textiles.

In the scouring process the soil is separated from the textile and dissolved, dispersed or emulsified in the cleaning solution and kept from being redeposited onto the fiber. The soil is removed by its solubility in water or, if it is insoluble, by a process of emulsification or dispersion in the detergent solution. There may be chemical reactions with any particular class of soil in order to render it water soluble or dispersible.

Both soaps and synthetic detergents are used as surface-active agents in scouring processes. These products reduce the surface tension of water and enable the water to wet the textile fibers more rapidly and uniformly. These products also provide the emulsifying and dispersing action needed for the removal of soil. Up to about 1930, soaps were the only satisfactory detergents known and used. However, there were serious limitations on their use because of their inability to function in acid media and in the presence of heavy-metal ions. The development of synthetic detergents has provided versatile surface-active compounds suitable for use under a wide variety of conditions, including the presence of acids, alkalies and a number of metal salts that precipitate soap. Synthetic detergents are highly effective when compared to soap, and replace soaps because they eliminate the possibility of soap deposits which frequently are a cause of imperfections in dyeing and finishing. Many of the more efficient ones are, however, expensive and do not have efficient wetting ability.

It is, therefore, an object of this invention to provide an alkaline scouring bath that will effectively clean natural cellulose fibers while rapidly wetting the fibers.

Another object of this invention is to provide a process for using the alkaline textile scouring bath.

Still another object of this invention is to provide a process for scouring textiles that not only cleans the textiles but also does not cause any substantial damage to the fibers.

Other objects, features and advantages of this invention will become apparent from the following detailed description.

SUMMARY OF THE INVENTION

It has been found that alkaline scouring baths having excellent wetting and cleaning ability for removing impurities from natural celluloses such as cotton are obtained with the addition thereto of at least 0.05% by weight of said bath of a mixture of a nonionic surfactant and a polycarboxylic acid or salt thereof having the formula

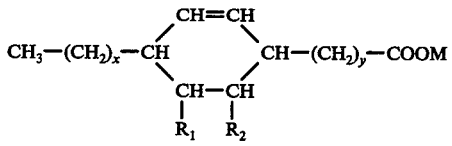

wherein $x$ and $y$ are integers from 3 to 9, $x$ and $y$ together equal 12, $R_1$ and $R_2$ are selected from the group consisting of hydrogen and COOM with at least one of $R_1$ and $R_2$ being COOM, and wherein M is a member of the group consisting of hydrogen, sodium, potassium, lithium and ammonium, the proportion of nonionic surfactant to polycarboxylic acid or salt thereof being between 1:0.4 and about 1:3.

DETAILED DESCRIPTION OF THE INVENTION

Aqueous alkaline scouring baths generally contain about from 1% to 14% by weight caustic. By the term caustic, it is meant alkali metal hydroxides, such as sodium hydroxide and potassium hydroxide, sodium carbonate (soda ash), trisodium phosphate and other like materials, normally used to produce alkaline scouring baths.

It has been found desirable to add to the alkaline scouring a cleaning agent comprising a mixture of a nonionic surfactant and those cycloaliphatic polycarboxylic acids or salts thereof described hereinbelow.

The cycloaliphatic polycarboxylic acid or salt thereof include those having the formula

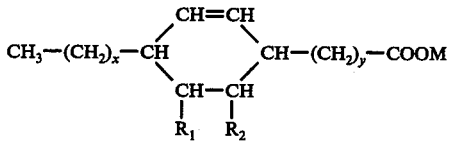

wherein $x$ and $y$ are integers from 3 to 9, $x$ and $y$ together equal 12, $R_1$ and $R_2$ are selected from the group of hydrogen and COOM with at least one of $R_1$ and $R_2$ being COOM, and wherein M is a member of the group consisting of hydrogen, sodium, potassium, lithium and ammonium. Instead of adding the salt of the polycarboxylic acid, the free polycarboxylic can be used inasmuch as it is converted into the salt form in the alkaline bath.

The salts of the cycloaliphatic polycarboxylic acids described herein are disclosed in U.S. Pat. No. 3,734,859 (May 23, 1973) to Ward, and pending application Ser. No. 622,254 filed Oct. 14, 1975, both incorporated herein by reference.

The nonionic surfactants can be any of a wide variety of surface active surfactants. Suitable nonionic surfactants include broadly ethoxylated alcohols and ethoxylated alkyl phenols. More particularly, the nonionics include polyoxyalkylene derivatives of polypropylene glycols, for examples, those sold under the trade name Pluronic by Wyandotte Chemicals Corp., alkylphenoxy poly(oxyethylene) ethanols made by G.A.F. under the trade name Igepal, and straight chain primary aliphatic oxyethylated alcohols such as the Plurafacs also by Wyandotte Chemicals Corp. Additionally, the Neodol type of nonionic surfactant made by Shell Chemical Co. and described as $C_{12}$-$C_{15}$ linear primary alcohol ethoxylates may be used. Also, ethoxylated octyl phenols sold by Rohm and Haas under the trade name Triton may be used. These nonionic surfactants and others useful in the invention are described in McCutcheon's "Detergents and Emulsifiers," 1972 Edition.

At least 0.05% by weight of said alkaline bath of combined nonionic surfactant and polycarboxylic acid or salt thereof is employed. The preferred range is from about 0.1% to about 0.5%. Beneficial results are not significantly increased if the amount of cleaning agent added is more than about 2.0%. The proportion of nonionic surfactant to polycarboxylic acid or salt thereof is from 1:0.4 to 1:3 by weight. The preferred ratio of nonionic surfactant to polycarboxylic acid or salt will to some extent depend upon the amount of caustic. When more caustic is present in the alkaline scouring bath, more polycarboxylic acid is desired.

The temperature of the scouring bath may be from about 72° F. to the boiling point of the scouring solution, but temperatures from about 140° to about 210° F. are preferred. It is understood that higher temperatures, such as 250° to 300° F., can be used with the aid of super-atmospheric pressure.

It is to be understood that the term "textile" material as used herein includes any natural and/or synthetic fibrous base material, such as cotton, nylon, viscose rayon, Dacron, polyester, hemp, linen, jute, and blends thereof such as, for example, cotton-Dacron, cotton-Dacron-viscose rayon, cotton-nylon-vicose rayon, cotton-Dacron-nylon, cotton-nylon, and cotton-polyester (all in various weight ratios).

Following scouring, the textiles are freed from the alkaline scouring solution by conventional methods, for example, rinsing prior to bleaching and/or dyeing.

The practice of this invention and the advantages provided thereby are further illustrated by the following examples.

EXAMPLE 1

This example illustrates the wettability of a textile scouring solution using the disodium salt of the polycarboxylic acid. Wettability was determined at 170° F. as the Draves Wetting Speed. This method involves dropping a standard skein of cotton yarn attached by means of a hook to a small weight into a cylinder containing the scouring bath and measuring the time required to wet.

A 10% sodium hydroxide solution was prepared. To this caustic solution was added 0.25% combined of the nonionic surfactant and the polycarboxylic acid salt at various ratios. A disodium $C_{21}$-cycloaliphatic dicarboxylic acid salt was used. The nonionic surfactant was an ethoxylated octyl phenol sold under the trade name Triton X-100 (Rohm & Haas). The scouring solutions were brought to temperature, and the wetting results are shown in the following Table I.

TABLE I

| Ratio of Nonionic to Dicarboxylic Acid Salt | Draves Wetting Speed, Seconds |
|---|---|
| - 0 - | >180.0 |
| 1:1.67 | 14.0 |
| 1:1.25 | 5.8 |
| 1:1.00 | 5.5 |
| 1:0.88 | 6.4 |
| 1:0.50 | 12 |

It can readily be seen that the scouring baths containing the non-ionic surfactant and dicarboxylic acid effectively reduce the wetting time of cotton textiles and thus clearly illustrates the synergism heretofore mentioned.

EXAMPLE 2

This example illustrates the effectiveness of scouring solutions using the free-acid form of the tricarboxylic acid. Wettability was determined at 170° F. as the Draves Wetting Speed according to the procedure of Example 1. A 10% sodium hydroxide solution was prepared. To this caustic solution was added 0.25% combined nonionic surfactant and the tricarboxylic acid at various ratios. The nonionic surfactant was a nonyl phenoxypoly(ethylene oxy) ethanol sold under the trade name Igepal CO-630 by G.A.F. The scouring solutions were brought to temperature, and the wetting results are shown in Table II.

TABLE II

| Ratio of Nonionic to Tricaboxylic Acid | Draves Wetting Speed, Seconds |
|---|---|
| - 0 - | >180.0 |
| 1:1.2 | 25.0 |
| 1:1.3 | 9.0 |
| 1:1.4 | 11.5 |
| 1:1.5 | 12.5 |

The results in Table II clearly illustrate the wetting efficiency of scouring solution using a mixture of nonionic surfactant and tricarboxylic acid.

While the invention has been described and illustrated herein by references to various specific materials, procedures and examples, it is understood that the invention is not restricted to the particular materials, combinations of materials, and procedures selected for that purpose. Numerous variations of such details can be employed, as will be appreciated by those skilled in the art.

What is claimed is:

1. In a process for treating textiles to remove impurities therefrom comprising scouring with an alkaline solution, the improvement which comprises;

adding to said aqueous alkaline scouring solution at least 0.05% by weight of said solution of a cleaning agent which comprises a mixture of a nonionic surfactant and a polycarboxylic acid or salt thereof having the formula

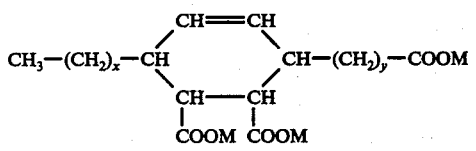

wherein $x$ and $y$ are integers from 3 to 9, $x$ and $y$ together equal 12, and wherein M is a member of the group consisting of hydrogen, sodium, potassium, lithium and ammonium, the weight ratio of nonionic surfactant to polycarboxylic acid or salt thereof being between about 1:0.4 and about 1:3.

2. The process according to claim 1 wherein said aqueous alkali scouring solution is at a caustic concentration of from 1% to 14% by weight.

3. The process according to claim 2 wherein said cleaning agent is present in an amount from 0.1% to about 0.5% by weight.

4. The process according to claim 3 wherein M is sodium.

5. The process according to claim 3 wherein said nonionic surfactant is a member of the group consisting of ethoxylated alcohols and ethoxylated alkyl phenols.

6. The process according to claim 2 wherein the temperature of said aqueous alkaline scouring solution during the textile treatment is from about 140° to about 210° F.

* * * * *